US006891117B1

(12) United States Patent
Gouhl et al.

(10) Patent No.: US 6,891,117 B1
(45) Date of Patent: May 10, 2005

(54) MODULAR BLOCK SWITCH ASSEMBLY

(75) Inventors: Erik J. Gouhl, Islip, NY (US); Gunter A. Gallas, Woodbury, NY (US); Jay J. Mendelson, Hartsdale, NY (US); Yuliy Rushansky, Port Washington, NY (US)

(73) Assignee: Cooper Wiring Devices, Inc., Long Island City, NY (US)

( * ) Notice: Subject to any disclaimer, the term of this patent is extended or adjusted under 35 U.S.C. 154(b) by 0 days.

(21) Appl. No.: 10/704,061

(22) Filed: Nov. 7, 2003

(51) Int. Cl.[7] ..... H01H 9/00; H01H 11/00; H01H 21/02

(52) U.S. Cl. ..... 200/339; 29/622; 200/553; 200/557

(58) Field of Search ..... 200/6 R, 6 B–6 C, 200/17 R, 18, 280, 281, 315, 316, 339, 434–439, 453–461, 553–562; 29/622

(56) References Cited

U.S. PATENT DOCUMENTS

| | | | | |
|---|---|---|---|---|
| 3,584,163 A | * | 6/1971 | White | 200/11 G |
| 3,770,820 A | | 11/1973 | Pollak | |
| 4,123,634 A | | 10/1978 | Hults | |
| 4,638,597 A | | 1/1987 | Lybecker | |
| 4,843,200 A | | 6/1989 | Parlatore et al. | |
| 5,207,317 A | | 5/1993 | Bryde et al. | |
| 5,380,972 A | | 1/1995 | Lunak et al. | |
| 5,382,768 A | * | 1/1995 | Kurek et al. | 200/556 |
| 5,384,441 A | | 1/1995 | Balaban et al. | |
| 5,500,498 A | * | 3/1996 | Kurek et al. | 200/556 |
| 5,570,778 A | | 11/1996 | Gernhardt et al. | |
| 5,595,289 A | * | 1/1997 | Kurek et al. | 200/559 |
| 5,630,502 A | | 5/1997 | Kurek et al. | |
| 5,647,479 A | | 7/1997 | Gernhardt et al. | |
| 5,731,559 A | | 3/1998 | Daccord | |
| 5,749,459 A | | 5/1998 | Balaban et al. | |
| 5,826,710 A | | 10/1998 | Kurek et al. | |
| 5,836,443 A | | 11/1998 | Gernhardt et al. | |
| 5,865,303 A | | 2/1999 | Gernhardt et al. | |
| 5,934,451 A | | 8/1999 | Yu et al. | |
| 5,950,812 A | | 9/1999 | Tanacan et al. | |
| 5,990,436 A | | 11/1999 | Balaban et al. | |
| 6,339,201 B1 | | 1/2002 | Balaban et al. | |

* cited by examiner

*Primary Examiner*—James R Scott
(74) *Attorney, Agent, or Firm*—Ostrager Chong Flaherty & Broitman P.C.

(57) ABSTRACT

An improved rocker-type switch has a toggle member pivotably mounted on a central pivot member in a frame of a top housing part joined to a bottom housing part holding switch contacts in a modular block subassembly. A pair of movable contact arms is actuated by spring-biased actuator members held in the central pivot member. The modular block subassembly has an insulative top block member, a top switch contact plate with switch contacts on upright tabs inserted through slots in the top block member, an insulative bottom block member sandwiching the top switch contact plate, and a bottom switch contact plate having switch contacts on upright tabs inserted through slots in the bottom and top block members, forming a pair of opposing switch contact positions for the movable contact arms. The switch contact plates have clip portions for inserting the tabs of respective switch contact terminal plates therein. For different switch configurations, e.g., single-pole, double-pole, 3-way, or 4-way operation, the switch contact plates are changed, but the same block subassembly and other parts can be used, thereby minimizing change of the surrounding parts, limiting insulative molding costs, eliminating tolerance stack-up, and facilitating assembly through automation.

40 Claims, 13 Drawing Sheets

MODULAR BLOCK SWITCH ASSEMBLY

TECHNICAL FIELD

This invention generally relates to a rocker-type switch, and more particularly, to one that utilizes a modular block subassembly that allows a product line to use interchangeable switch contact elements for configuring single pole, double pole, 3-way, and 4-way switches with minimal changes to surrounding parts and elimination of tolerance stack up in the switch mechanism.

BACKGROUND OF INVENTION

The rocker-type electrical wall switch has long been known for its advantages of operating switch contacts through limited angular movement of a pivoted rocker, thus allowing the ends of the rocker to remain substantially flush in the rocker frame for aesthetics. U.S. Pat. No. 3,770,920 to Polliak disclosed a rocker-type switch in which the rocker is pivotally supported in a housing at a first pivot point, a movable plate supporting a contact brush is pivotally supported at a second pivot point in the housing, and a spring is compressed between a downwardly extending boss on the rocker and a lower end of the plate supporting the contact brush, so that the spring is movable under compression to bias the contact brush plate to opposite inclined positions in response to pivotal movement of the rocker between its up and down positions. The contact brush makes contact in each rocker position with a switch contact supported on a respective one of a pair of terminal plates to which respective wire leads are attached, in order to form a single-pole rocker-type switch.

U.S. Pat. No. 5,382,768 to Kurek et al. disclosed another rocker-type switch in which a rocker actuator arm is moved in response to movement of a rocker cover to move a slider back and forth to open and close one or more pairs of switch contacts. Rocker movement is controlled by a rocker cam leaf spring which has a cammed profile traversed by the rocker cam to move the slider between switch contact positions, lock the rocker and provide other desired functions. The rocker cam spring is housed in a spring chamber longer than itself, allowing the rocker cam spring to float. A fixed terminal assembly is engaged with a switch contact assembly against which the slider moves to make contact and thereby close the switch, or moves away from to open the switch. The terminal assembly can be implemented in single-pole, double-pole, and double-throw for 3-wire or 4-wire circuit arrangements. A sheet metal mounting strap provides a cradle-like support for holding the switch in a wall box.

U.S. Pat. No. 5,950,812 to Tanacan et al. disclosed another rocker-type switch in which a star-shaped spring provides the necessary forces to hold the rocker to a switch spacer and to couple the rocker to a movable contact arm. The movable contact arm is inserted in the switch spacer and makes contact between opposing switch contacts. The star-shaped spring is made of flat spring stock and is selectively bent with star-shaped bends to enable the various switch contact functions. A V-notch receives the end of the movable contact arm and moves the arm between the two switch contact positions as the rocker is operated.

While there have been many variations of and improvements to the rocker-type switch, the conventional rocker-type switch still has certain problems that remain to be solved. One main problem is that changing the arrangement of the rocker-type switch to single-pole, double-pole, 3-way, or 4-way switch configurations requires that different terminal plates or wiring arrangements be used with different insulative parts in the terminal housing subassembly, thereby requiring substantial change to or reconfiguration of the switch parts. Also, the manufacture of different insulative parts of expensive, high temperature plastic material increases the costs for the overall product line. The required assembly of different manufactured parts in different configurations also results in tolerance error stack-up when the parts are assembled together, thereby leading to problems in terms of fit and alignment of the parts and the switch contacts.

SUMMARY OF INVENTION

It is therefore a principal object of the present invention to provide a rocker-type switch that can be readily configured to single-pole, double-pole, 3-way, or 4-way switch arrangements with minimal change to the surrounding parts. Specifically, it is desired to provide a rocker-type switch in which a modular block subassembly is used with interchangeable switch contacts to enable reconfiguration for other switch configurations with only minimal change to the surrounding parts. It is another object of the invention to limit the manufacture of insulative parts of expensive, high temperature plastic material to a modular block subassembly that can be used for different switch configurations, thereby minimizing the costs for the overall product line. It is yet another object of the invention to eliminate tolerance error stack-up when parts are assembled together, thereby providing more accurate fit and alignment of parts and switch contacts.

In accordance with the present invention, an improved rocker-type switch comprises:

(a) a toggle member pivotably movable on a pivot member within a frame of a top housing part, said toggle member being arranged to be pivoted between up and down rocker positions within said frame;

(b) at least one movable contact arm having an upper end which is coupled to said toggle member and a lower end mounting a switch contact which is movable alternately between a pair of switch contact positions when said toggle member is pivoted between up and down rocker positions;

(c) a bottom housing part made of electrically insulative material having a central aperture for holding a modular block subassembly therein, said bottom housing part being arranged to mate in contact with said top housing part when assembled thereto with said modular block assembly encased therebetween;

(d) said modular block subassembly having at least one block member made of electrically insulative material for holding at least one switch contact plate therein, said at least one block member and said at least one switch contact plate being configured to define a pair of opposing switch contact positions in said modular block subassembly between which said switch contact of said movable contact arm is moved alternately when said toggle member is pivoted between up and down rocker positions, and said modular block subassembly having means for connecting said at least one switch contact plate in electrical contact with a terminal plate that is separate from said modular block subassembly; and (e) at least one terminal plate arranged in said bottom housing part separate from said modular block subassembly having means for establishing an electrical contact with said at least one switch contact plate, whereby the rocker-type switch can be configured for different switch configurations by changing the configuration of the switch contact plate(s) in said modular block subassembly with minimal change to the surrounding parts.

In a preferred embodiment, the improved rocker-type switch is configured with space to accommodate a pair of movable contact arms arranged side-by-side to be pivoted by a pair of respective actuator members held in the pivot member positioned widthwise on the underside of the toggle member. The modular block subassembly is configured with space to define two pairs of opposing switch contact positions arranged in parallel alongside each other.

The subassembly can be configured selectively with one or more block member(s) and switch contact plate(s) for single-pole, double-pole, 3-way, and 4-way switch configurations. The switch contact plate(s) are connected to the respective terminal plate(s) by clip and tab portions, or any other suitable means of establishing an electrical connection therebetween. For a single-pole switch configuration, one switch contact plate has one switch contact thereon that may be positioned at one switch contact position for one movable contact arm. For a double-pole switch configuration, two switch contact plates each have one switch contact thereon that may be positioned at one respective switch contact position for each of two movable contact arms. For a 3-way switch configuration, two switch contact plates each have one switch contact thereon that may be positioned at opposite switch contact positions for one movable contact arm. For a 4-way switch configuration, two switch contact plates each have two switch contacts thereon that may be positioned at respective opposing switch contact position for two movable contact arms.

In a preferred assembly of a 4-way switch configuration, the preferred modular block subassembly is assembled in "drop-in" fashion with an insulative top block member having upright walls defining hollow spaces for receiving the depending ends of the two movable contact arms therein, a top switch contact plate having switch contacts mounted on upright tabs which are inserted through respective slots in the top block member, an insulative bottom block member sandwiching the top switch contact plate between it and the top block member, and a bottom switch contact plate having switch contacts mounted on upright tabs which are inserted through respective aligned slots in the bottom and top block members to switch contact positions opposite those of the top switch contact plate. The bottom block member is joined to the top block member by any suitable means. Two terminal plates with wire clamp members are arranged on opposite lateral sides toward one end of the bottom housing part and connected to the respective switch contact plates. Two cradle half plates for the movable contact arms with wire clamp members are arranged on opposite lateral sides toward the other end of the bottom housing part and electrically coupled to the respective movable contact arms. The top and bottom housing parts are held together by a rigid outer strap and by a pair of drive pins that are inserted through holes in the strap and in the bottom housing part and fastened to corresponding fastener members in the top housing part.

The top and bottom block members of the modular block subassembly may be molded from high temperature plastic material. The top block member does not need to be changed for different switch configurations. Thus, the improved switch of the present invention can limit the costs of molding expensive insulative parts for a complete product line. Also, since the modular block assembly uses the same top housing parts, movable contact arms, terminal plates, contact arm plates, and rocker assembly for the different switch configurations, fabrication costs for the whole product line are reduced, and the problem of tolerance error stack-up is eliminated for the parts assembly. The design of the modular block subassembly and its encapsulation between the top and bottom housing parts also provide for substantial noise reduction in electrical hum, improved dielectric spacing between open electrical contacts, and elimination of distortion due to any over-torqueing when attaching electrical leads to the wire clamp members.

Other objects, features, and advantages of the present invention will be explained in the following detailed description of the invention having reference to the appended drawings.

DETAILED DESCRIPTION OF INVENTION

Certain preferred embodiments of the improved rocker-type switch of the present invention are described in detail below. It is understood that many other variations and modifications could be implemented by those skilled in the field to which this invention pertains, given the principles of the invention disclosed herein.

Figure 1:
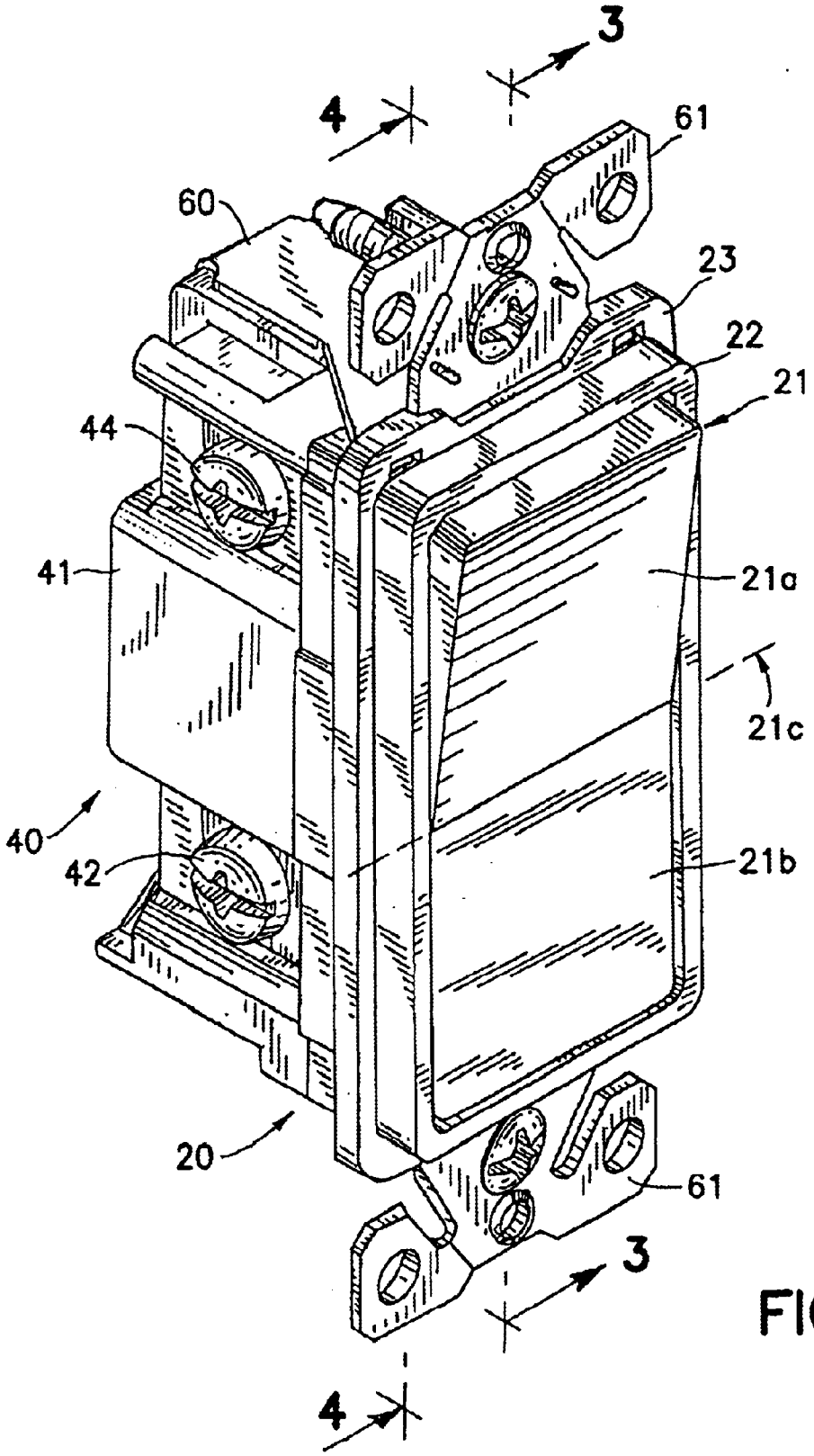
FIG. 1 is a perspective, assembled view of an improved rocker-type switch in accordance with the present invention.

Referring to FIG. 1, an improved rocker-type switch in accordance with the present invention is shown in perspective, assembled view having a top housing part 20 mated with a bottom housing part 40 and secured together with an outer strap 60. The top housing part 20 has a toggle member 21 pivotable on a central pivot member (shown later) within a top housing frame 22 between up and down rocker positions. The toggle member is preferably formed with planar half sections 21*a* and 22*b* inclined slightly (about 6.5 degrees) with respect to each other on opposite sides of a center pivot axis (indicated by reference number 21*c*), with half section 21*a* shown in the up-rocker position projecting slightly above the level of the frame 22, and half section 21*b* shown in the down-rocker position substantially flush with the level of the frame 22. The top housing part has walls defining the frame in a rectangular shape and made of electrically insulative material, and has an outer edge band 23 around its periphery.

The bottom housing part 40 has outer walls made of electrically insulative material which define a central aperture (indicated generally by reference numeral 41) for holding a modular block subassembly therein (shown later) and side apertures for holding terminal plates for the switch. A pair of wire clamp members (posts and screws) 42 for switch contact terminal plates are provided on opposite lateral sides of the bottom housing part toward one end thereof (lower end in the drawing), and another pair of wire clamp members 44 for contact arm terminal plates are provided on opposite lateral sides toward the opposite end of the bottom housing part (upper end in the drawing) for attaching other terminal wire leads thereto. The outer strap 60 fits around the bottom and side walls of the bottom housing part 40 with end plates 61 projecting from opposing sides of the joined housing parts for mounting to a wall box.

Figure 2:
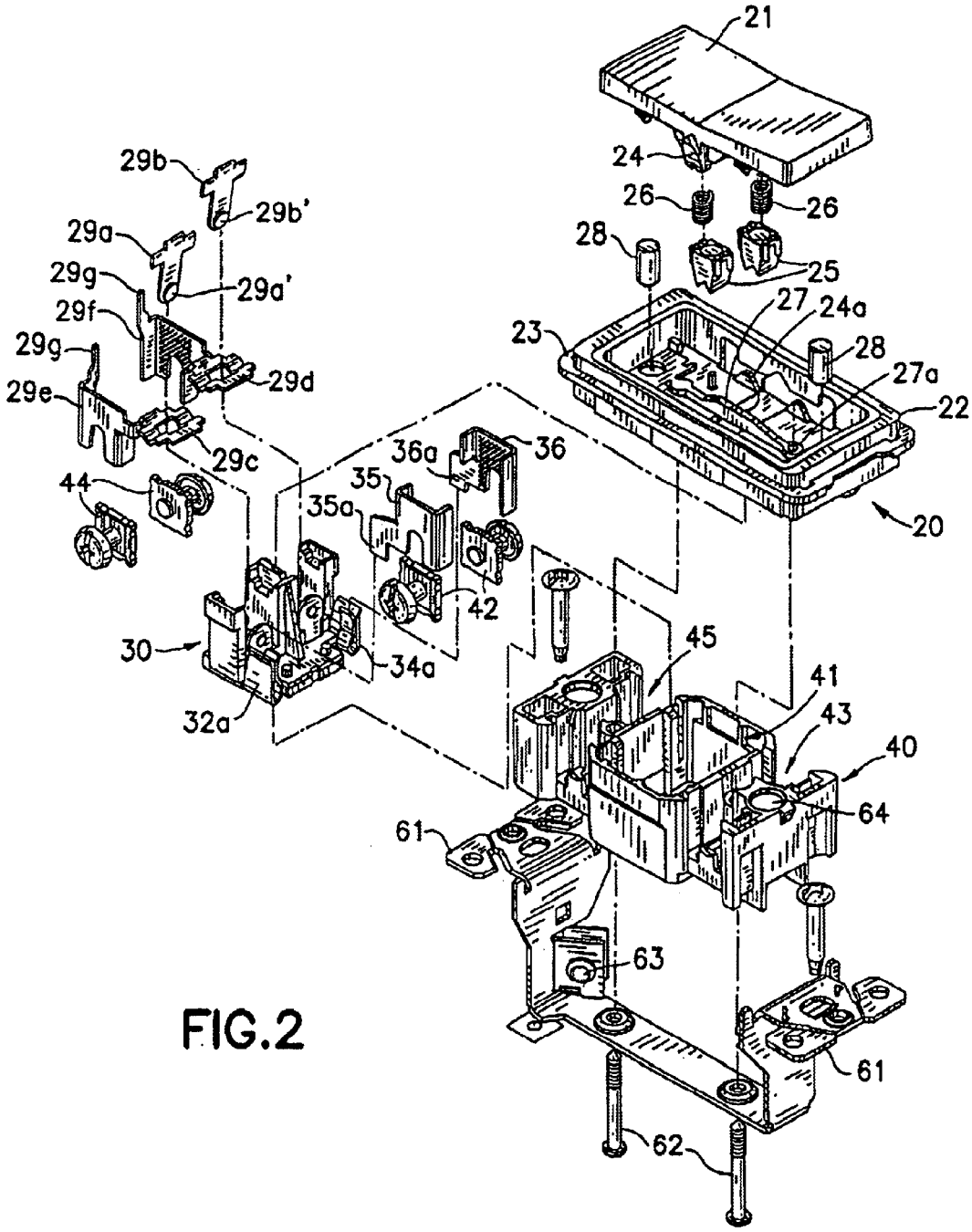
FIG. 2 is an exploded, assembly view of a preferred embodiment of a 4-way switch configuration of the rocker-type switch.

FIG. 2 shows an assembly view of a preferred embodiment of a 4-way switch configuration of the rocker-type switch which has a full complements of parts, including a pair of movable contact arms, two switch contact plates defining two pairs of opposing switch contact positions in tandem with each other, a pair of terminal plates, and a pair of contact arm plates (to be described further below). The toggle member 21 and subassembly, top housing part 20, modular block subassembly 30, bottom housing part 40, and strap 60 are assembled in "drop-in" fashion as shown. The upper surfaces of the bottom housing part 40 are shaped and arranged to mate in tight contact with the lower surface of the top housing part 20 when assembled thereto.

Forming the toggle subassembly, the toggle member has a central pivot member 24 extending across its lateral width and provided with two downwardly-facing recesses (not visible in the drawing) for holding a pair of actuator members 25 and biasing springs 26 therein that are used to pivot the movable contact arms 29*a*, 29*b* between opposing switch contact positions in response to up and down movement of the toggle member 21. The top housing part 20 has frame 22 with walls defining a rectangular cavity in which the toggle member is seated. The ends of the central pivot member are movably seated in and constrained for rocking movement within the triangular volume defined by the triangular posts 24*a* formed adjacent each side wall of the frame 22. On the floor of the rectangular cavity is a stiffening rib 27 extending lengthwise in the top housing part for structural rigidity. The stiffening rib 27 is centered between the two recesses holding the actuator members 25 and biasing springs 26 so as not to interfere with the movement of the movable contact arms 29*a*, 29*b*. The range of movement of the contact arms is defined by the switch contact positions in the modular block subassembly 30 (described in detail below). A pair of bumper posts 28 is fixed in the top housing part to act as a backstop and protect the moving parts from over-travel.

The modular block subassembly 30 has upright walls defining spaces to accommodate the pair of movable contact arms 29*a*, 29*b* and is seated in the central aperture 41 in the bottom housing part 40 to be encased between it and the top housing part 20. The modular block subassembly 30 (described in detail further below) is formed as a separate part from the other surrounding parts of the switch. The switch contact plates in the modular block subassembly are electrically connected to the terminal plates in the bottom housing part by any suitable means, such as by the clip portions 32*a* and 34*a* which are positioned on opposite lateral sides of the subassembly 30 receiving the respective tab portions 35*a*, 36*b* of the terminal plates 35 and 36. The terminal plates have wire clamp members (posts and screws) 42 for clamping the wire leads wired thereto. Another benefit of forming the terminal plates separately from the switch contact plates in the modular block subassembly is that over-torqueing of the screws when attaching the wire leads to the terminal plates does not cause any distortion to the switch contacts.

The pair of movable contact arms 29*a*, 29*b* have respective movable arm contacts 29*a*', 29*b*' on their lower ends which are moved in tandem between opposing switch contact positions in response to the up and down movement of the toggle member 21. The movable contact arms are seated in electrical contact with cradles 29*c*, 29*d* formed with respective cradle plate halves 29*e*, 29*f*. The cradle plate halves 29*e*, 29*f* have wire clamp members 44 for holding corresponding wire leads. The upper ends of the movable contact arms 29*a*, 29*b* are engaged with respective ones of the actuator members 25 of the toggle subassembly. Movement of the toggle member 21 pivots the actuator members 25 which turns the upper ends of the movable contact arms 29*a*, 29*b*, causing the movable arm contacts 29*a*', 29*b*' to swing from one switch contact position to the other in the modular block subassembly. The cradle plate halves 29*e*, 29*f* are shown in the drawing with ears 29*g* that extend upwardly through the floor of the top housing part to make electrical contact with light bulbs or LEDs to illuminate the switch, such as through translucent plastic material used to form the toggle member. The ears 29*g* and bulbs or LEDs are omitted in a non-illuminated switch.

The top and bottom housing parts may be joined together in several ways to form a sturdy switch unit. Hanging bosses on the lower surfaces of the top housing part 20 fit within walls 64 of the bottom housing part and can be ultrasonically welded thereto by positioning an ultrasonic horn along the walls of the rectangular cavity of the top housing part. The mated top and bottom housing parts are girdled in the rigid metal strap 60, and a pair of drive pins 62 are inserted through holes formed in the strap and in the bottom housing part 40 and have their ends fastened to fastener members 27*a* in the top housing part 20. The fastening method can be by threading in threaded fastener holes or press-fitting drive pin ends with zero-pitch threading. A wire clamp member (post and screw) 63 is formed on one side of the strap 60 for attaching a ground lead.

Figure 3:
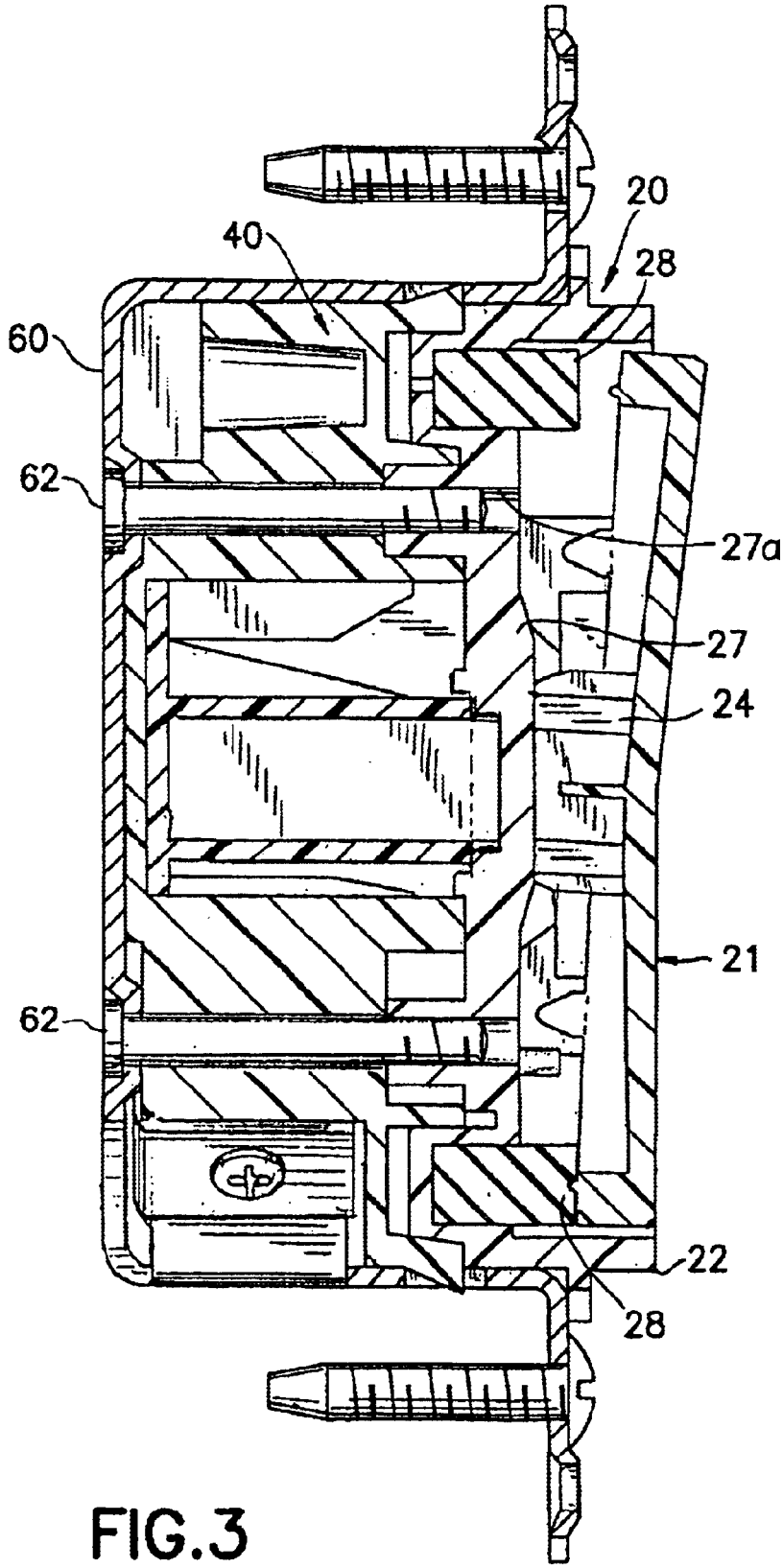
FIG. 3 is a side view in cross-section of the improved rocker-type switch taken along viewline 3—3 in FIG. 1.

FIG. 3 is a side view in cross-section of the improved rocker-type switch taken along the center viewline 3—3 in FIG. 1. The toggle member 21 has the pivot member 24 positioned at its center axis. The bumper posts 28 mark the limits of travel for the ends of the toggle member 21 in the frame 22. The stiffening rib extends along the centerline of the top housing part 20. The drive pins 62 are shown inserted through holes in the bottom housing part 40 and threaded or press-fitted into the fastener members 27*a* in the top housing part 20.

Figure 4:
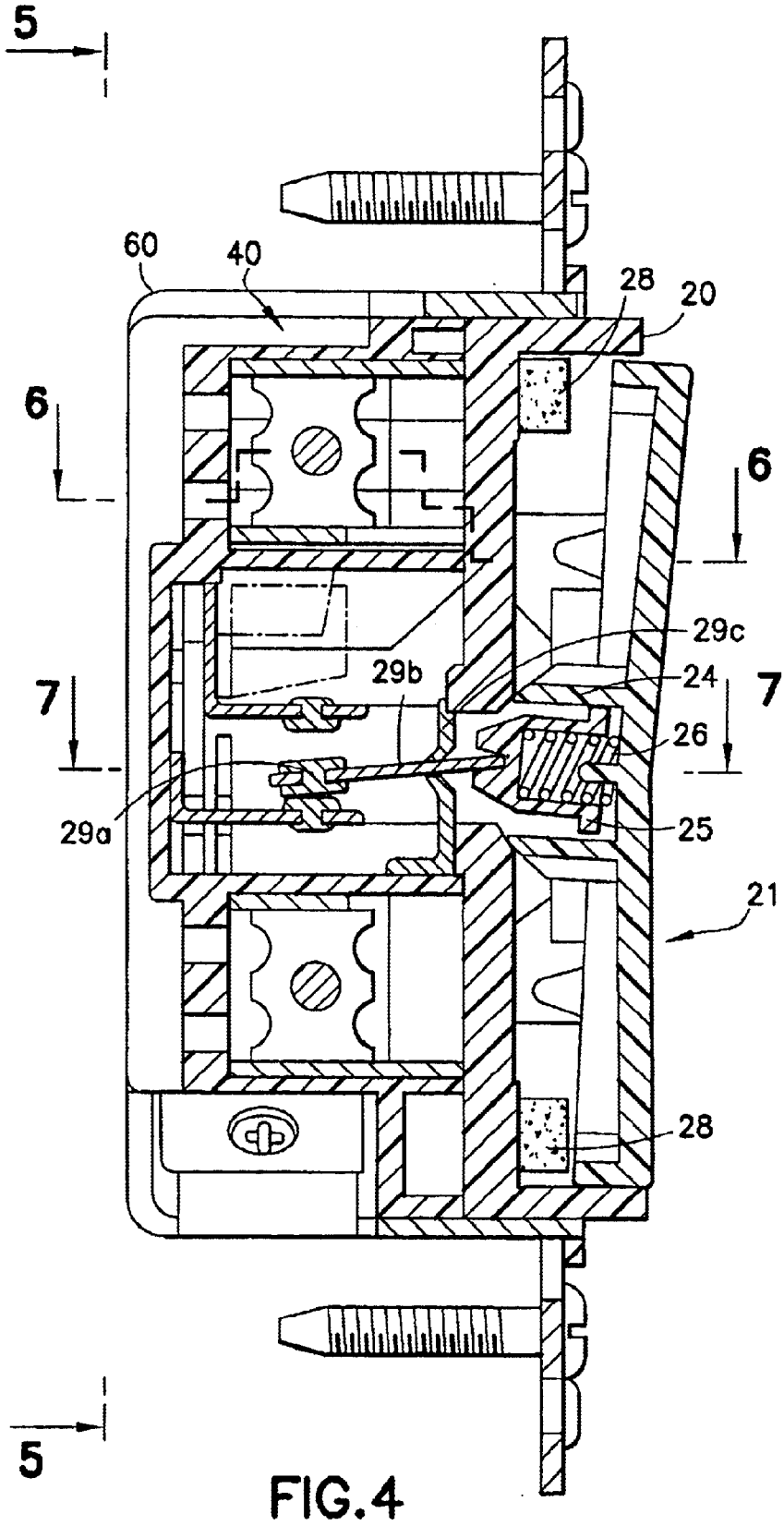
FIG. 4 is a side view in cross-section of the improved rocker-type switch taken along viewline 4—4 in FIG. 1.

FIG. 4 is a side view in cross-section of the improved rocker-type switch taken along viewline 4—4 in FIG. 1. The actuator member 25 is shown held in a recess formed in the central pivot member 24 and biased by the spring 26 against the upper end of the movable contact arm 29*a* seated in a V-shaped notch therein, such that a pivot movement of the toggle member 21 and actuator 25 causes the upper end of the movable contact arm 29*a* to be swung from one side to the other. The movable contact arm 29*a* is pivotably held on the cradle portion 29*c*. Pivoting the upper end of the movable contact arm 29*a* in one direction or the other causes the contact 29*a*' on its lower end to move in the opposite direction and make contact with the switch contact there.

Figure 5:
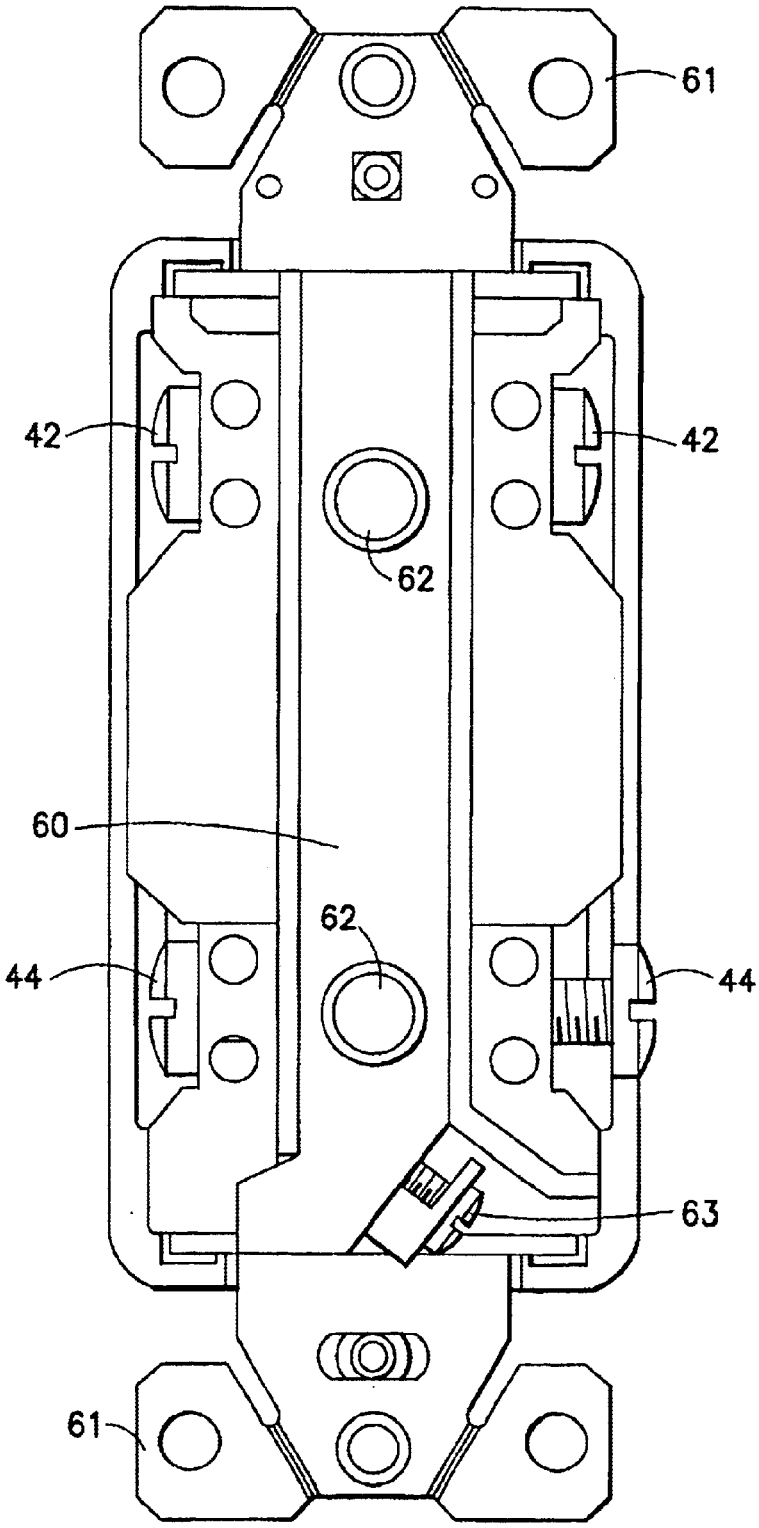
FIG. 5 is a bottom view of the improved rocker-type switch.

FIG. 5 is a bottom view of the improved rocker-type switch, showing the outer strap 60, projecting portions 61, drive pins 62, ground wire clamp 63, wire clamp members 42 for the terminal plates connected to the switch contacts, and wire clamp members 44 for the cradle plates halves connected to the movable arm contacts.

Figure 6:
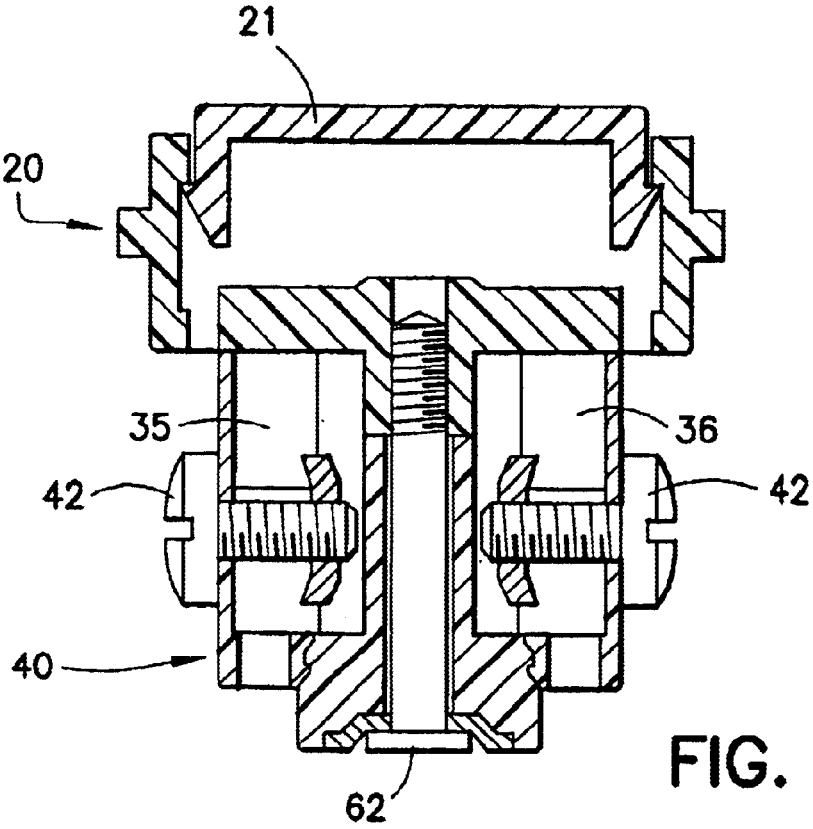
FIG. 6 is a sectional view of the improved rocker-type switch taken along viewline 6—6 in FIG. 4.

FIG. 6 is a sectional view of the improved rocker-type switch taken along viewline 6—6 in FIG. 4, showing the wire clamp members 42 mounted to the switch contact terminal plates 35, 36, and drive pins 62 securing the top housing part 20 and bottom housing part 40 together.

Figure 7:
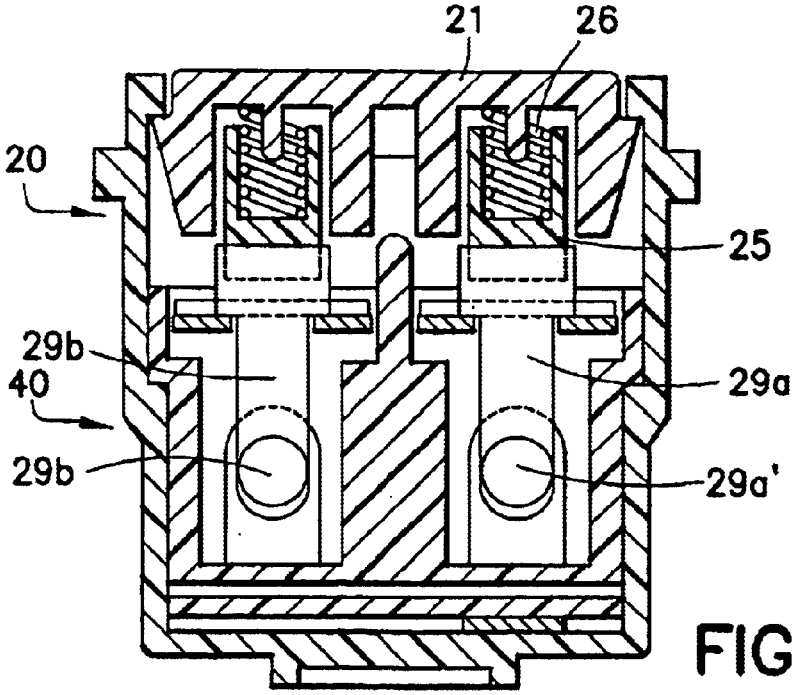
FIG. 7 is a sectional view of the improved rocker-type switch taken along viewline 7—7 in FIG. 4.

FIG. 7 is a sectional view of the improved rocker-type switch taken along viewline 7—7 in FIG. 4, showing the positions of the flipper actuator members 25 and movable contact arms 29*a*, 29*b* and flipper contacts 29*a*', 29*b*'.

Figure 8B:
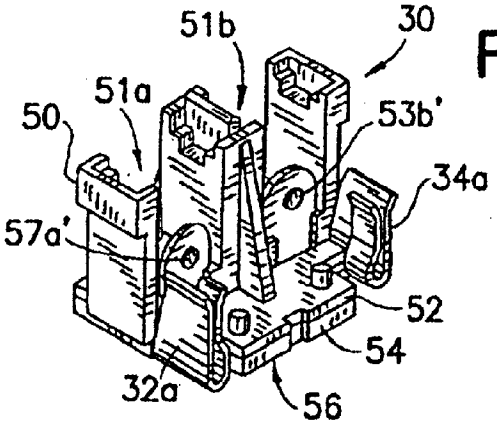
FIGS. 8A, 8B, and 8C are assembly, top perspective and bottom perspective views of the modular block subassembly for a 4-way switch configuration of the rocker-type switch shown in FIG. 2.
Figure 8C:
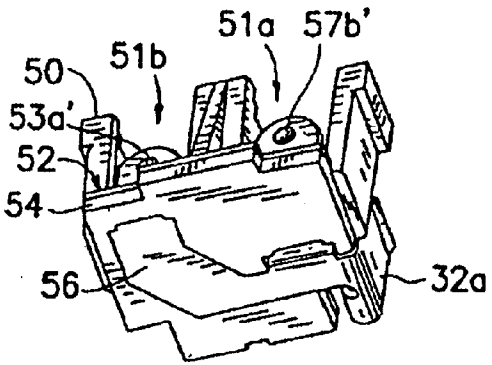
Figure 8A:
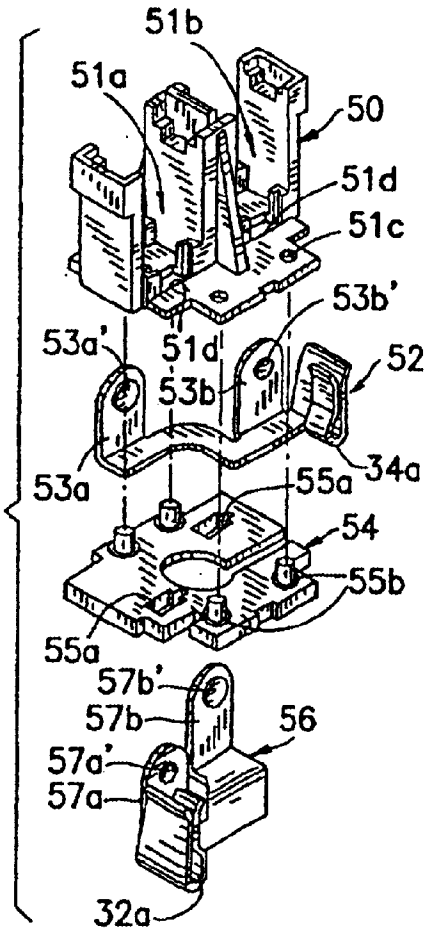

In FIGS. 8A, 8B and 8C, the modular block subassembly for the preferred embodiment of a 4-way switch configuration is shown in assembly (top-down order), top perspective, and bottom perspective views. A top block member 50 is made of electrically insulative material with upright walls defining a pair of hollow spaces 51*a*, 51*b* (left and right side in the drawing) in tandem for receiving the lower ends of the pair of movable contact arms therein. Next, a top switch contact plate 52 is formed of electrically conductive material with a pair of upright, crossover tabs 53*a*, 53*b* having switch contacts 53*a*', 53*b*' thereon. The upright tabs are inserted through respective slots 51*d* in the top block member to position the switch contacts 53*a*', 53*b*' at respective switch contact positions on opposite sides of each of the tandem spaces 51*a*, 51*b*. A clip portion 34*a* is formed on one lateral side (right side in the drawing) of the top switch contact plate to connect it to a corresponding terminal plate by receiving the terminal plate tab therein.

A bottom block member 54 is made of electrically insulative material for sandwiching the top switch contact plate 52 between it and the top block member 50 and electrically insulating it from the bottom switch contact plate 56. The bottom switch contact plate 56 is formed of electrically conductive material with a pair of upright, crossover tabs 57*a*, 57*b* having switch contacts 57*a*', 57*b*' thereon. A clip portion 32*a* is positioned on an opposite lateral side (left side of the drawing) of the block subassembly to connect the bottom switch contact plate 56 to a corresponding terminal plate by receiving the terminal plate tab therein. The switch contact tabs of the bottom switch contact plate 56 are inserted through slots 55*a* formed in the bottom block member 54 and through aligned slots 51*d* in the top block member 50 to be positioned at opposite switch contact positions in each of the hollow spaces 51*a*, 51*b*.

The bottom block member 54 has spaced stacking pins 55*b* on its upwardly facing surface that are inserted through aligned holes 51*c* in the top block member 50 and are ultrasonically welded. Other means of joining these block members together may be used, such as heat staking or gluing. The top and bottom block members may be molded from a high-quality, heat-resistant and insulative material, such as glass-filled Nylon. The rigid, high temperature material ensures safe operation of the switch subassembly. The design of the block subassembly in layers isolates critical tolerance parts from each other, thereby eliminating tolerance error stack-up.

The complete switch unit is assembled by seating the assembled modular block subassembly into the central aperture 41 of the bottom housing part 40 (see FIG. 2), then the switch contact terminal plates 35, 36 with wire clamp members 42 and the movable contact arms 29*a*, 29*b* coupled to cradle plates halves 29*e*, 29*f* with wire clamp members 44 are dropped into the side apertures 43 and 45, respectively. The top and bottom housing parts 20 and 40 are then assembled together, the strap 60 is positioned around the housing parts, and the drive pins 62 are pushed in through the holes in the strap and bottom housing part and fastened (press-fitted, threaded, welded, glued, etc.) to the fastener members 27*a* in the top housing part. The bumper posts 28 are pressed into place, then the toggle subassembly with member 21, actuator members 25 and springs 26 held therein is snap-fitted into the rectangular cavity in the top housing part. The modular "drop in" design of the switch parts and subassemblies allows the unit to be readily assembled through automation.

In the 4-way switch configuration shown, the switch contacts are positioned on opposite sides of the two switch contact pairs, so that pivoting the toggle member in one direction results in one cradle plate half being connected to one terminal plate then to the other terminal plate when the toggle member is pivoted the opposite way, and vice versa for the other cradle plate half. The switch contacts could instead be arranged without crossover tabs, but rather tabs on the same side of each switch contact pair, so that pivoting the toggle member in one direction connects both cradle plate halves to one terminal plate at the same time, and both cradle plate halves to the other terminal plate when the toggle member is pivoted the opposite way. The 4-way switch arrangement has a full complement of parts that permits it to be wired in various configurations including but not limited to, single pole, 3-way, double pole and 4-way.

Figure 9A:
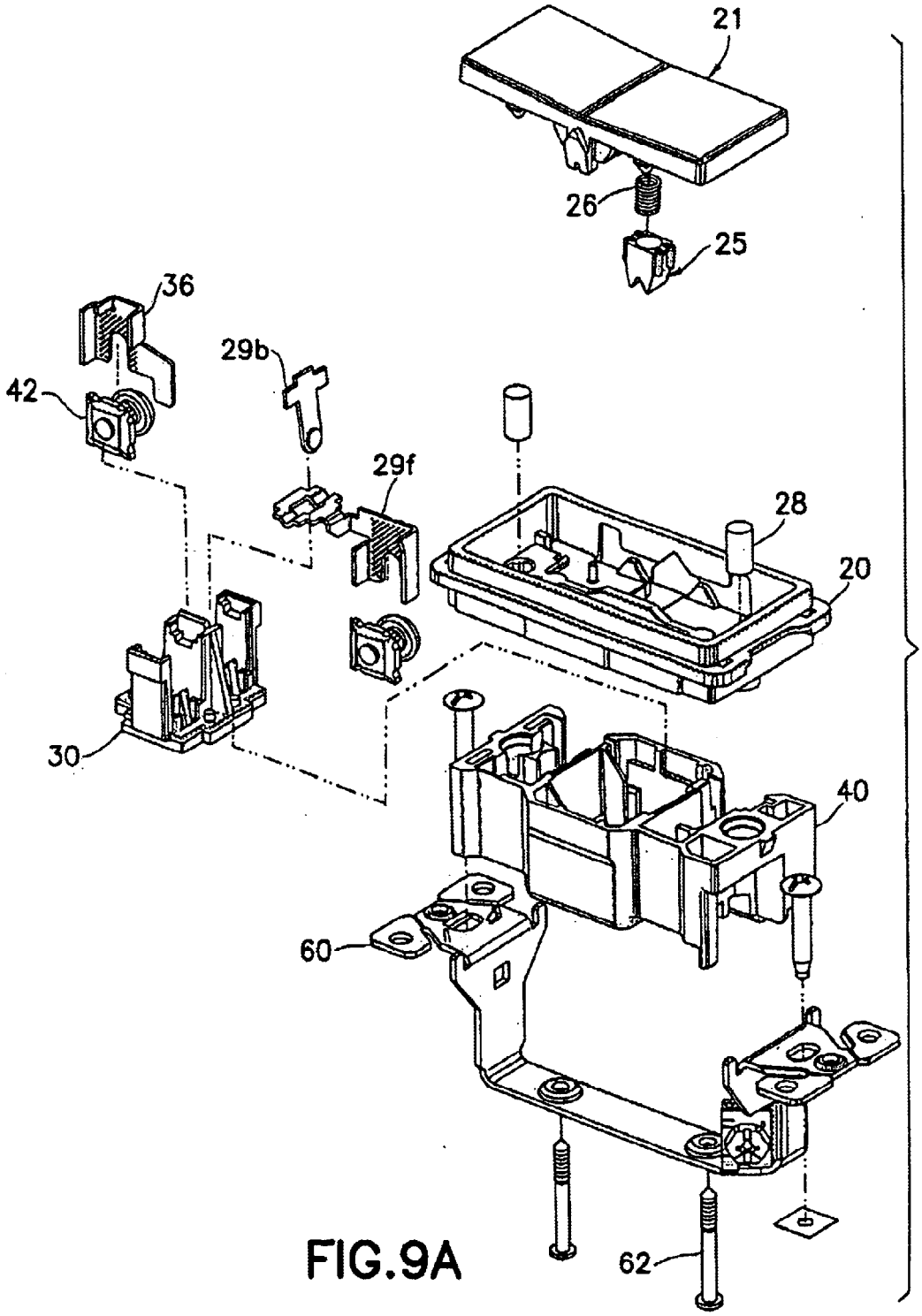
FIGS. 9A and 9B are exploded, assembly views of a preferred embodiment of a single-pole switch configuration of the rocker-type switch and its modular block subassembly, respectively.
Figure 9B:
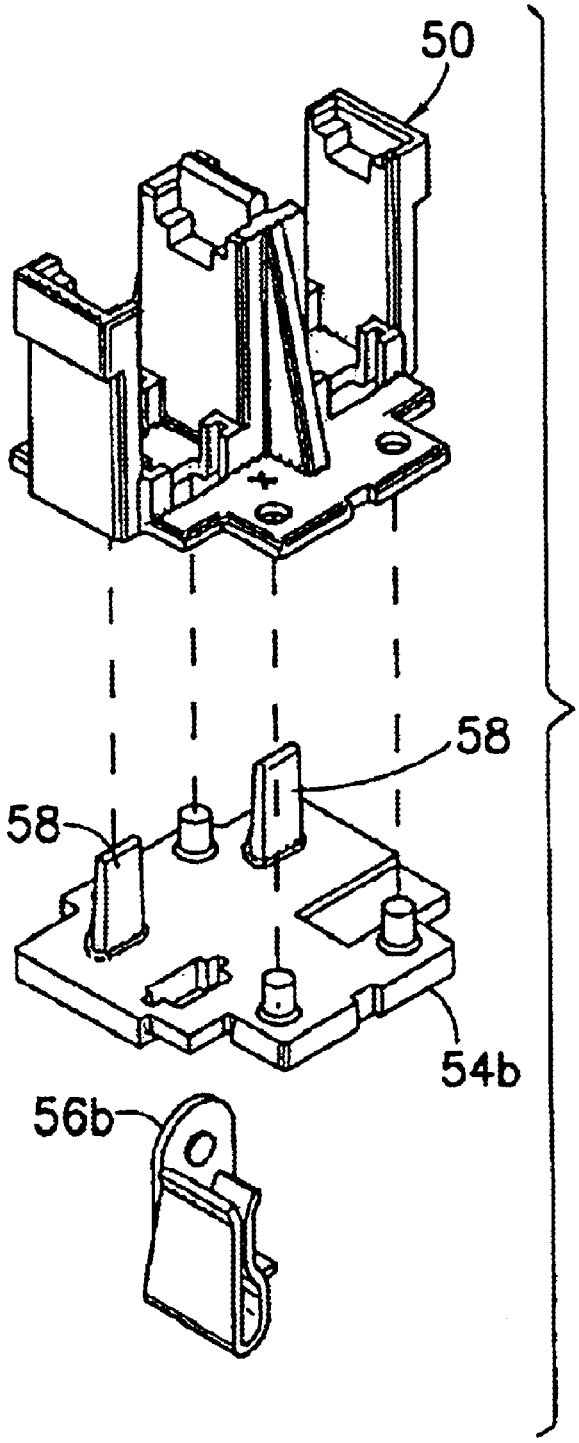

Other switch configurations may be included in a whole product line using the same component parts except for changing the configuration of the switch contact plates and omitting any unnecessary parts. In FIGS. 9A and 9B, assembly views of a preferred embodiment of a single-pole switch configuration and its modular block subassembly are shown, respectively. The rocker 21, compression spring 26, actuator 25, top housing part 20, bottom housing part 40, movable contact arm 29*b*, contact arm cradle plate half 29*f* and wire clamp member 42, switch contact terminal plate 36 and wire clamp member 44, and strap 60 are the same as before. Note that when the rocker is used in a single-pole application, only one of the contact arms, actuators, compression springs, cradle plate halves, and terminal plates is utilized. The bottom housing part may be adapted especially for the single-pole arrangement with two openings for the required terminals. The block subassembly uses the same upper block component 50 and one (54*b*) of two versions of the lower block component. The lower block version 54*b* used in the single-pole block assembly has two stop ribs 58. These ribs are used to stop the rotation of the contact arm in the off position. Principally, the parts that differentiate each type of block assembly are the switch contact plates. The single-pole assembly uses only one switch contact plate with one switch contact thereon in conjunction with one movable contact arm for the single-pole arrangement. Note that this single-pole contact 56*b* is actually a modified part from the 4-way lower switch contact plate 56 and may even be manufactured from the same die. Other versions of the single-pole arrangement may be made by using the other contact arm, switch contact plate, and/or switch contact positions.

Figure 10A:
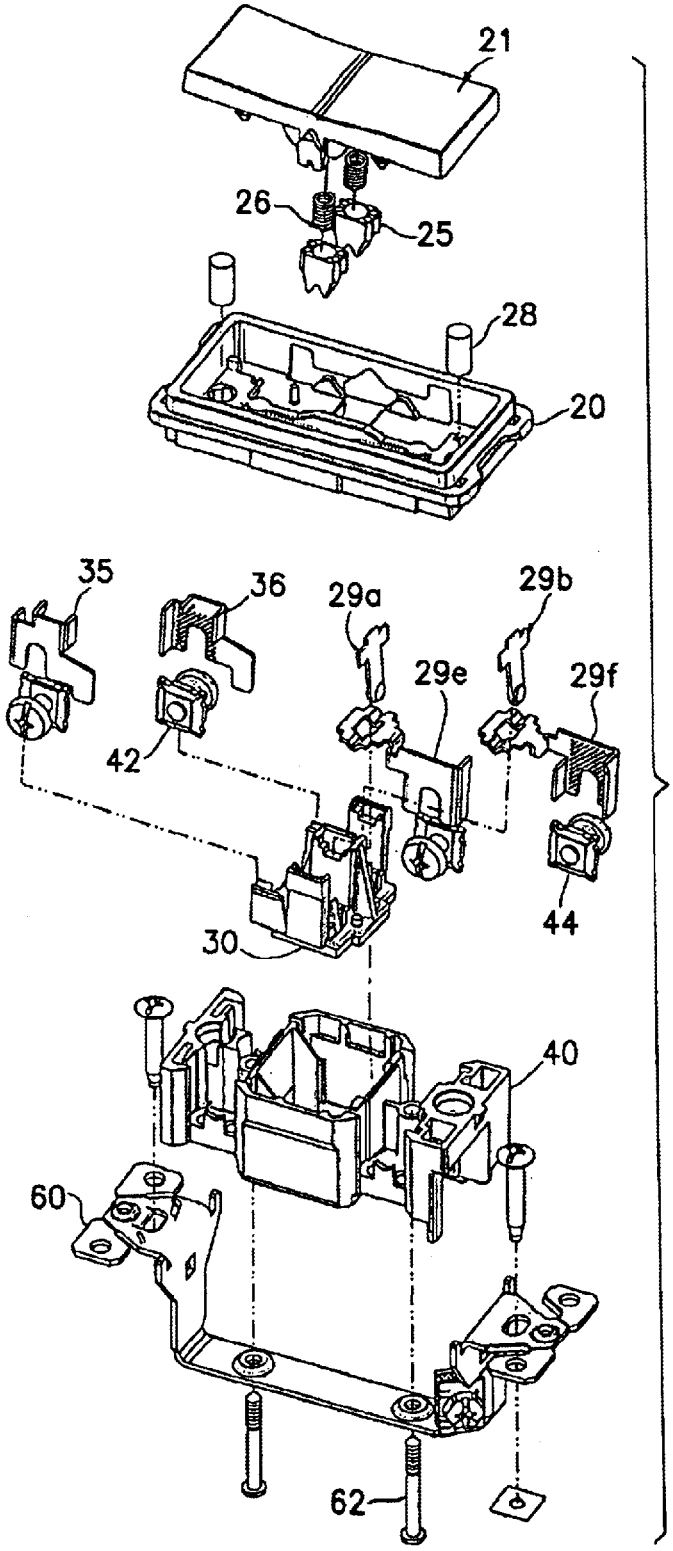
FIGS. 10A and 10B are exploded, assembly views of a preferred embodiment of a double-pole switch configuration of the rocker-type switch and its modular block subassembly, respectively.
Figure 10B:
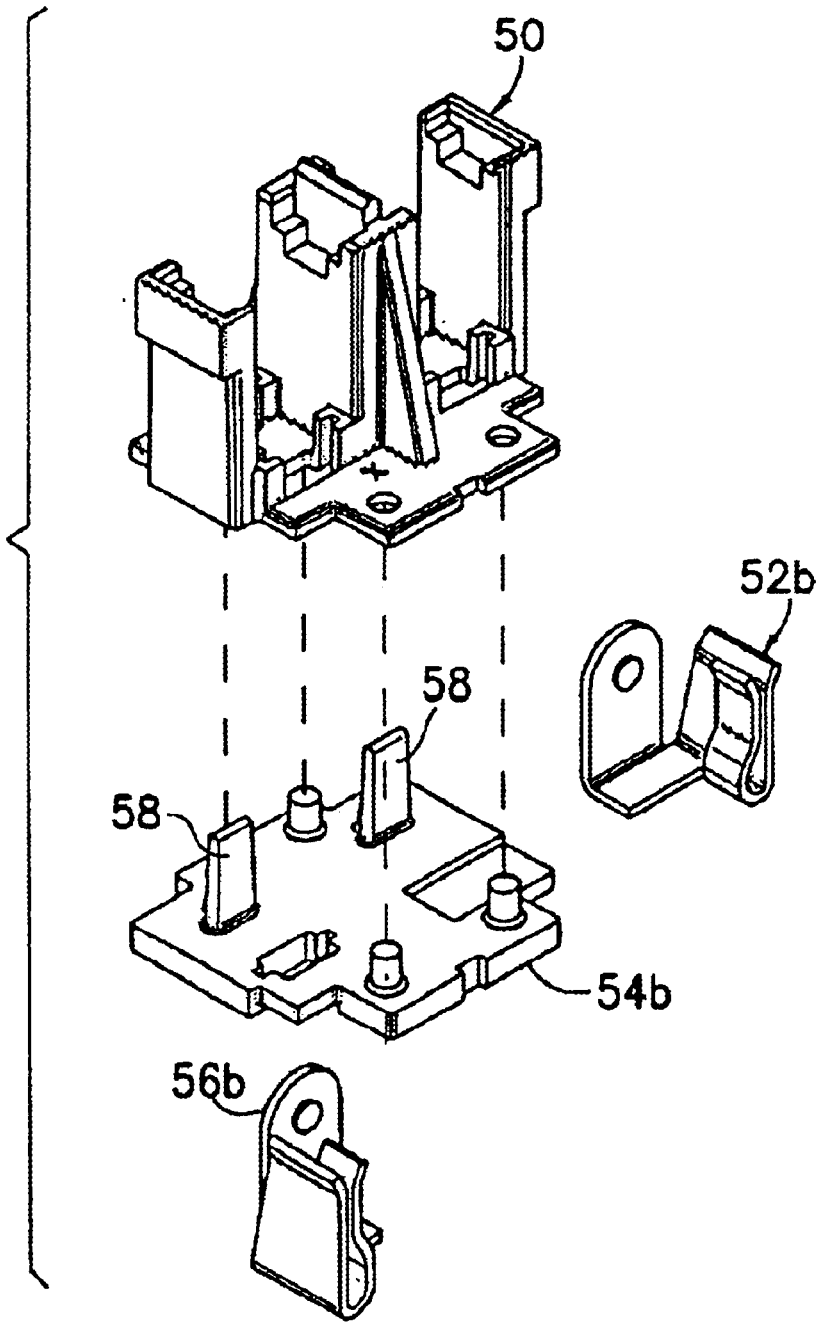

FIGS. 10A and 10B are exploded, assembly views of a preferred embodiment of a double-pole switch configuration of the rocker-type switch and its modular block subassembly, respectively. The surrounding parts around the block subassembly are the same as before. Two contact arms, actuators, compression springs, cradle plate halves, and terminal plates are utilized. The double-pole version uses the same bottom housing part 40 as the 4-way version. The block assembly uses the same upper block component 50 and the lower block component 54*b* that has the two stop ribs 58. The stop ribs are required to stop the rotation of the contact arms in the off position. The double-pole assembly uses two switch plates each with one switch contact in opposite switch contact positions. Note that the switch contact plate 52*b* is actually a modified part from the upper switch contact plate 52 from the 4-way version, and the other switch contact plate 56*b* is a modified version of the lower switch contact plate 52 from the 4-way version, and both may be manufactured from the corresponding 4-way die.

Figure 11A:
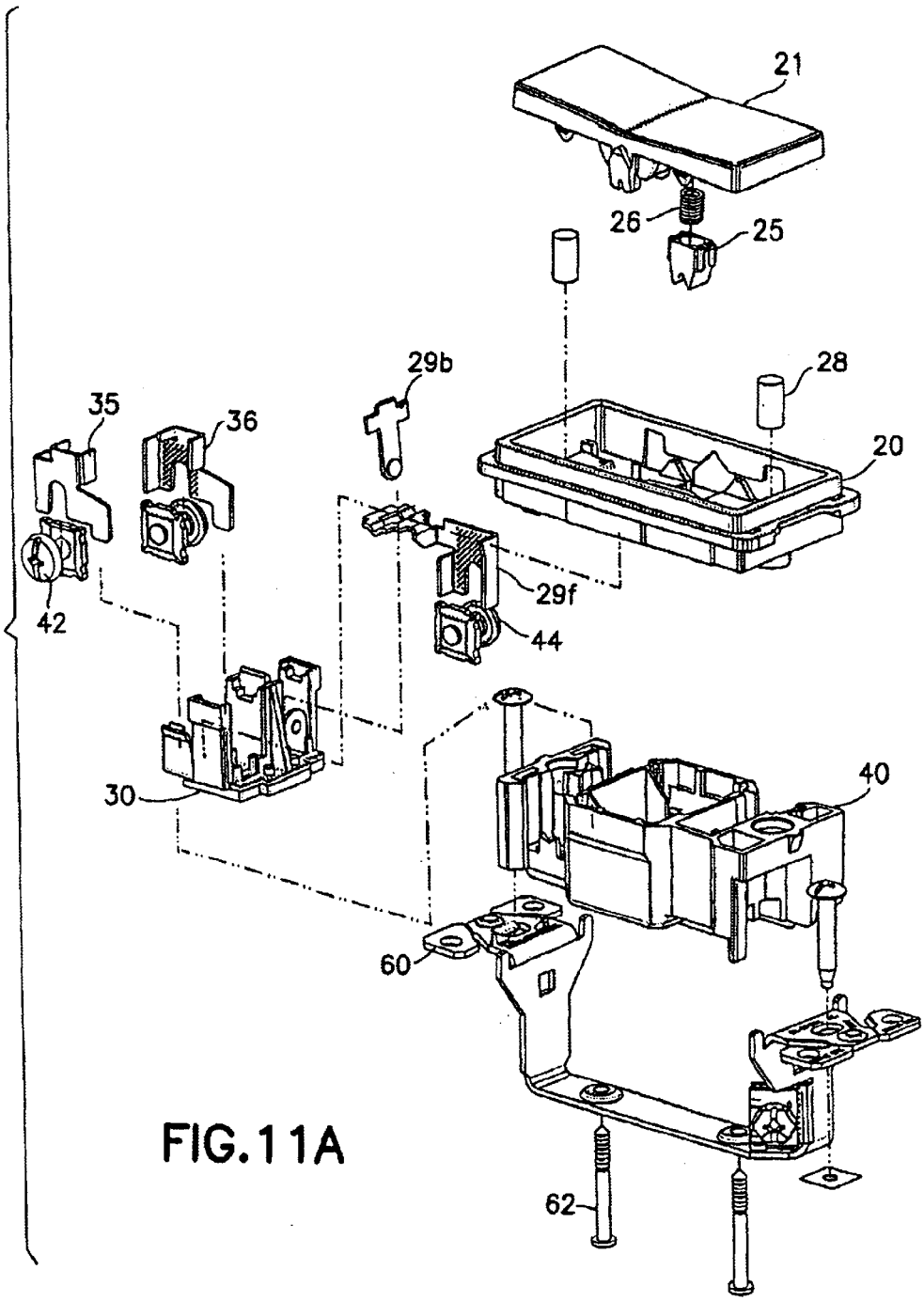
FIGS. 11A and 11B are exploded, assembly views of a preferred embodiment of a 3-way switch configuration of the rocker-type switch and its modular block subassembly, respectively.
Figure 11B:
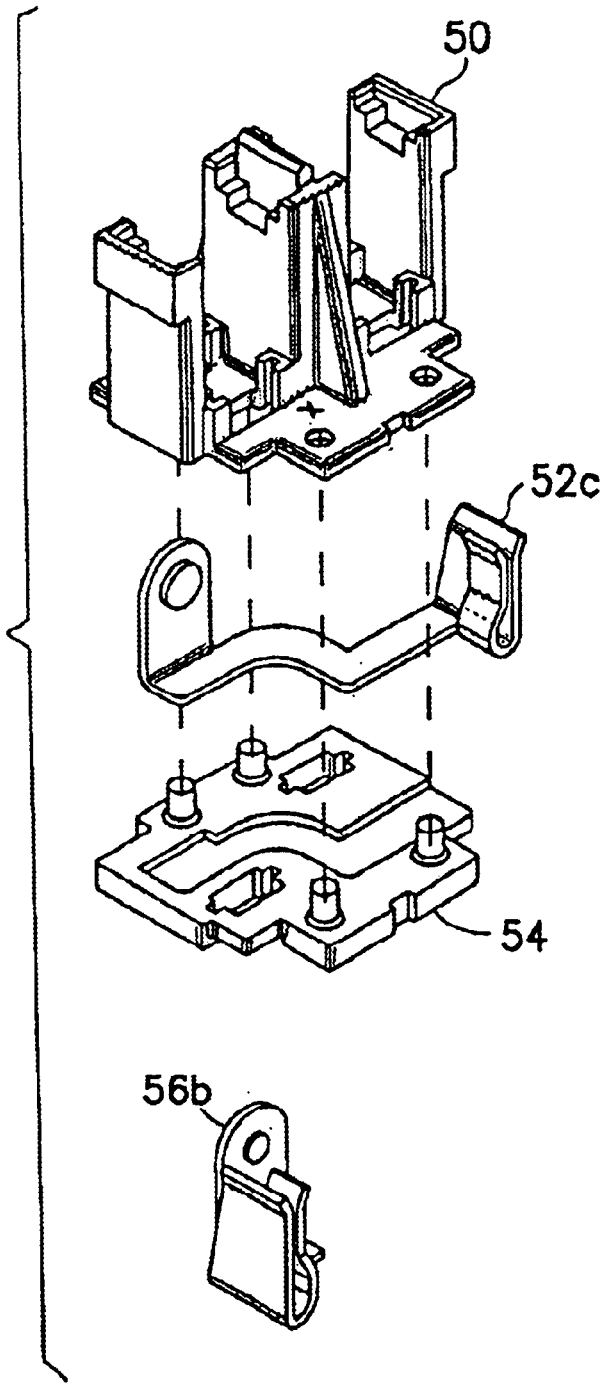

FIGS. 11A and 11B are exploded, assembly views of a preferred embodiment of a 3-way switch configuration of the rocker-type switch and its modular block subassembly, respectively. The surrounding parts around the block subassembly are the same as before. Note that in the 3-way application, only one of the two switch contact spaces is utilized, and only one contact arm, actuator, compression spring, and cradle plate half are utilized. The bottom housing part 40*b* is unique to the 3-way arrangement, and has three openings for the two switch contact plate terminals 35 and 36 and one cradle plate half 29*f*. The block assembly uses the same upper block component 50 and the same lower block component 54 as the 4-way lower block (does not have any stop ribs). The 3-way block assembly uses two switch contact plates in conjunction with one contact arm. Note that one switch contact is formed from the modified lower switch contact plate 56*b* (described above) and the other is a modified version of the 4-way upper crossover switch contact plate but with only one switch contact. These may be manufactured from the same die as those parts described above. Other versions of the single-pole arrangement may be made by using the other contact arm, switch contact plate, and/or switch contact positions.

For the modular block subassembly, the top and bottom block members may be molded from high temperature plastic material and do not need to be changed for different switch configurations. Thus, the improved switch of the present invention can limit the costs of molding expensive insulative parts for a complete product line. Also, since the modular block assembly uses only one set of molded block members, and the same top and bottom housing parts, movable contact arms, terminal plates, contact arm plates, and rocker assembly are used for the different switch configurations, fabrication costs for the whole product line are reduced, and the problem of tolerance error stack-up is eliminated for the parts assembly.

In summary, the improved rocker-type switch is designed to be configured for different switch configurations of a product line by changing the configuration of the switch contact plate(s) in said modular block subassembly with minimal change to the surrounding parts. The block subassembly has a modular "drop in" design that facilitates ease of assembly and allows it to be performed through automation. The modular block subassembly and its encapsulation between the top and bottom housing parts also provide for substantial noise reduction in the electrical hum that can occur in the hollow bodies of conventional rocker-type switches. Also, the arrangement of the modular block subassembly provides an improved dielectric spacing between open electrical contacts, and eliminates distortion of contacts if a user exerts high torque when wiring electrical leads to the terminal wire clamp screws.

It is understood that one skilled in this field, given the described principles of the present invention, may make other modifications and variations, such as to the various switch components, assemblies, layouts, materials, and switch configurations described above. It is intended that all such modifications and variations be considered as within the spirit and scope of this invention, as defined in the following claims.

We claim:

1. An improved rocker-type switch comprises:

(a) a toggle member pivotably movable on a pivot member within a frame of a top housing part, said toggle member being arranged to be pivoted between up and down rocker positions within said frame;

(b) at least one movable contact arm having an upper end which is coupled to said toggle member and a lower end mounting a switch contact which is movable alternately between a pair of switch contact positions when said toggle member is pivoted between up and down rocker positions;

(c) a bottom housing part made of electrically insulative material having a central aperture for holding a modular block subassembly therein, said bottom housing part being arranged to mate in contact with said top housing part when assembled thereto with said modular block assembly encased therebetween;

(d) said modular block subassembly having at least one block member made of electrically insulative material for holding at least one switch contact plate therein, said at least one block member and said at least one switch contact plate being configured to define a pair of opposing switch contact positions in said modular block subassembly between which said switch contact of said movable contact arm is moved alternately when said toggle member is pivoted between up and down rocker positions, and said modular block subassembly having means for connecting said at least one switch contact plate in electrical contact with a terminal plate that is separate from said modular block subassembly; and (e) at least one terminal plate arranged in said bottom housing part separate from said modular block subassembly having means for establishing an electrical contact with said at least one switch contact plate, whereby the rocker-type switch can be configured for different switch configurations by changing the configuration of the switch contact plate(s) in said modular block subassembly with minimal change to the surrounding parts.

2. An improved rocker-type switch according to claim 1, wherein said pivot member of said toggle member is positioned on a central rocker axis and extends widthwise on an underside surface of said toggle member.

3. An improved rocker-type switch according to claim 1, wherein said pivot member has a recess therein for holding an actuator member with spring for biasing said actuator member into pivotable contact with an upper end of said movable contact arm.

4. An improved rocker-type switch according to claim 1, wherein said modular block subassembly includes an insulative top block member having upright walls defining a hollow space for receiving the lower end of said at least one movable contact arm therein.

5. An improved rocker-type switch according to claim 4, wherein said modular block subassembly includes a top switch contact plate having one or more switch contacts mounted on upright tab(s) which are inserted through respective slot(s) in said top block member.

6. An improved rocker-type switch according to claim 5, wherein said modular block subassembly includes an insulative bottom block member sandwiching said top switch contact plate between it and said top block member.

7. An improved rocker-type switch according to claim 6, wherein said modular block subassembly includes a bottom switch contact plate having one or more switch contacts mounted on upright tab(s) which are inserted through respective aligned slot(s) in said bottom and top block members to switch contact position(s) opposite those of said top switch contact plate.

8. An improved rocker-type switch according to claim 6, wherein said top and bottom block members have respective means for joining the block members together.

9. An improved rocker-type switch according to claim 8, wherein said joining means includes said bottom block member being provided with spaced stacking pins on an upward facing surface thereof that are inserted into aligned holes in said top block member and ultrasonically welded thereto.

10. An improved rocker-type switch according to claim 1, comprising a pair of movable contact arms held in respective cradle plate halves having their upper ends in pivotable contact with a pair of respective actuator members held in respective recesses in said pivot member on an underside surface of said toggle member and their lower ends depending in respective hollow spaces formed in said bottom housing part.

11. An improved rocker-type switch according to claim 10, wherein said pair of movable contact arms is arranged side-by-side in electrical contact with respective cradle plate halves provided with respective wire clamp members on opposite lateral sides of the bottom housing part.

12. An improved rocker-type switch according to claim 1, wherein a pair of switch contact terminal plates is provided with respective wire clamp members on opposite lateral sides of said bottom housing part.

13. An improved rocker-type switch according to claim 1, wherein said modular block subassembly includes an insulative top block member having upright walls defining a pair of hollow spaces side-by-side for receiving the lower end(s) of one or two movable contact arms therein, and an insulative bottom block member to be joined to said top block member.

14. An improved rocker-type switch according to claim 13, adapted to a single-pole switch configuration, having one movable contact arm arranged to pivot between opposing switch contact positions in one of the hollow spaces of said top block member, and a lower switch contact plate provided with one switch contact mounted on an upright tab which is inserted through respective slots in said top and bottom block members to one of the switch contact positions in said one hollow space of said top block member.

15. An improved rocker-type switch according to claim 14, adapted to a single-pole switch configuration, wherein said bottom block member is provided at least one stop rib for stopping rotation of the contact arm at the switch contact position where no switch contact is provided.

16. An improved rocker-type switch according to claim 13, adapted to a double-pole switch configuration, having two movable contact arms arranged to pivot between opposing switch contact positions in the two hollow spaces of said top block member, an upper switch contact plate provided with one switch contact mounted on an upright tab which is inserted through a slot in said top block member to a switch contact position in one of the hollow spaces of said top block member, and a lower switch contact plate provided with one switch contact mounted on an upright tab which is inserted through respective slots in said top and bottom block members to a switch contact position in tandem with that of the upper switch contact plate in the other of the hollow spaces of said top block member.

17. An improved rocker-type switch according to claim 16, adapted to a double-pole switch configuration, wherein said bottom block member is provided a pair of stop ribs for stopping rotation of the contact arms at the switch contact positions where no switch contacts are provided.

18. An improved rocker-type switch according to claim 13, adapted to a 3-way switch configuration, having one movable contact arm arranged to pivot between opposing switch contact positions in one of the hollow spaces of said top block member, an upper switch contact plate provided with one switch contact mounted on an upright tab which is inserted through a slot in said top block member to a switch contact position in the one hollow space of said top block member, and a lower switch contact plate provided with one switch contact mounted on an upright tab which is inserted through respective slots in said top and bottom block members to a switch contact position opposite that of the upper switch contact plate in the one hollow space of said top block member.

19. An improved rocker-type switch according to claim 18, adapted to a 3-way switch configuration, wherein said upper switch contact plate has a crossover tab and switch contact, and said bottom housing part is provided with means for mounting a pair of switch contact terminal plates and respective wire clamp members on opposite lateral sides at one end of said bottom housing part, and one cradle plate half with wire clamp member on one lateral side at another end of said bottom housing part.

20. An improved rocker-type switch according to claim 13, adapted to a 4-way switch configuration, having two movable contact arms arranged to pivot between opposing switch contact positions in respective ones of the two hollow spaces of said top block member, an upper switch contact plate provided with a pair of switch contacts mounted on respective upright tabs which are inserted through respective slots in said top block member to opposite switch contact positions in respective ones of the two hollow spaces of said top block member, and a lower switch contact plate provided a pair of switch contacts mounted on respective upright tabs which are inserted through respective slots in said top and bottom block members to opposite switch contact positions opposite that of the upper switch contact plate in respective ones of the two hollow spaces of said top block member.

21. An improved rocker-type switch according to claim 20, adapted to a 4-way switch configuration, wherein said bottom housing part is provided with means for mounting a pair of switch contact terminal plates and respective wire clamp members on opposite lateral sides at one end of said bottom housing part, and a pair of cradle plate halves and respective wire clamp members on opposite lateral sides at another end of said bottom housing part.

22. An improved rocker-type switch according to claim 21, wherein said cradle plate halves and said switch contact terminal plates are adapted to be wired in a switch configuration from a group consisting of: (a) single-pole configuration; (b) double-pole configuration; (c) 3-way configuration; and (d) 4-way configuration.

23. An improved rocker-type switch according to claim 1, wherein said means for connecting said at least one switch contact plate in electrical contact with a terminal plate is formed by said at least one switch contact plate having a clip portion for receiving a terminal tab inserted therein, and the terminal plate having a tab portion for inserting in electrical contact with the clip portion of the switch contact plate.

24. A toggle subassembly for a rocker-type switch employing at least one movable contact arm pivotable between opposing switch contact positions, comprising:

(a) a top housing part having a frame of a given length and width for holding the toggle subassembly therein;

(b) a toggle member of elongated shape having a pair of toggle member parts arranged in a lengthwise direction on opposite sides of a pivot axis, and a pivot member extending in a widthwise direction formed on an underside surface of said toggle member (c) said pivot member being mounted in said frame for pivotable movement between up and down rocker positions and having at least one recess therein for holding an actuator member and compression spring for biasing said actuator member into pivotable contact with an upper end of a movable contact arm to be used with said toggle subassembly.

25. A toggle subassembly for a rocker-type switch according to claim 24 adapted for operating a pair of movable contact arms, wherein said pivot member is formed with two recesses for holding respective ones of a pair of actuator members and compression springs for biasing said actuator members into pivotable contact with respective upper ends of the pair of movable contact arms.

26. A toggle subassembly for a rocker-type switch according to claim 24, wherein said actuator member has a V-shaped groove on a lower surface thereof in which the upper end of the movable contact arm is placed in abutting contact for pivoting from one side to the other of said V-shaped groove when said toggle member is moved between up and down positions.

27. A modular block subassembly for a rocker-type switch employing at least one movable contact arm pivotable between opposing switch contact positions, comprising:

(a) an insulative top block member having upright walls defining at least one hollow space for receiving a lower end of the at least one movable contact arm therein;

(b) an insulative bottom block member to be joined to said top block member;

(c) at least one switch contact plate having one or more switch contacts mounted on upright tab(s) which are inserted through respective aligned slot(s) in said bottom block member and/or said top block member to a respective switch contact position(s);

(d) said at least one switch contact plate having means for establishing an electrical connection with a terminal plate positioned externally of said modular block subassembly.

28. A modular block subassembly for a rocker-type switch according to claim 27, wherein said insulative top block member has upright walls defining a pair of hollow spaces side-by-side for receiving the lower end(s) of one or two movable contact arms therein.

29. A modular block subassembly for a rocker-type switch according to claim 28, adapted to a single-pole switch configuration having one movable contact arm arranged to pivot between opposing switch contact positions in one of the hollow spaces of said top block member, and a lower switch contact plate provided with one switch contact mounted on an upright tab which is inserted through respective slots in said top and bottom block members to one of the switch contact positions in said one hollow space of said top block member.

30. A modular block subassembly for a rocker-type switch according to claim 29, adapted to a single-pole switch configuration, wherein said bottom block member is provided at least one stop rib for stopping rotation of the contact arm at the switch contact position where no switch contact is provided.

31. A modular block subassembly for a rocker-type switch according to claim 28, adapted to a double-pole switch configuration having two movable contact arms arranged to pivot between opposing switch contact positions in the two hollow spaces of said top block member, an upper switch contact plate provided with one switch contact mounted on an upright tab which is inserted through a slot in said top block member to a switch contact position in one of the hollow spaces of said top block member, and a lower switch contact plate provided with one switch contact mounted on an upright tab which is inserted through respective slots in said top and bottom block members to a switch contact position in tandem with that of the upper switch contact plate in the other of the hollow spaces of said top block member.

32. A modular block subassembly for a rocker-type switch according to claim 31, adapted to a double-pole switch configuration, wherein said bottom block member is provided a pair of stop ribs for stopping rotation of the contact arms at the switch contact positions where no switch contacts are provided.

33. A modular block subassembly for a rocker-type switch according to claim 28, adapted to a 3-way switch configuration, having one movable contact arm arranged to pivot between opposing switch contact positions in one of the hollow spaces of said top block member, an upper switch contact plate provided with one switch contact mounted on an upright tab which is inserted through a slot in said top block member to a switch contact position in the one hollow space of said top block member, and a lower switch contact plate provided with one switch contact mounted on an upright tab which is inserted through respective slots in said top and bottom block members to a switch contact position opposite that of the upper switch contact plate in the one hollow space of said top block member.

34. A modular block subassembly for a rocker-type switch according to claim 33, adapted to a 3-way switch configuration, wherein said upper switch contact plate has a crossover tab and switch contact, so that the upper and lower switch contact plates can be electrically connected to terminal plates on opposite lateral sides of said modular block subassembly.

35. A modular block subassembly for a rocker-type switch according to claim 28, adapted to a 4-way switch configuration having two movable contact arms arranged to pivot between opposing switch contact positions in respective ones of the two hollow spaces of said top block member, an upper switch contact plate provided with a pair of switch contacts mounted on respective upright tabs which are inserted through respective slots in said top block member to opposite switch contact positions in respective ones of the two hollow spaces of said top block member, and a lower switch contact plate provided a pair of switch contacts mounted on respective upright tabs which are inserted through respective slots in said top and bottom block members to opposite switch contact positions opposite that of the upper switch contact plate in respective ones of the two hollow spaces of said top block member.

36. A modular block subassembly for a rocker-type switch according to claim 27, wherein said means for establishing an electrical connection with an external terminal plate includes said at least one switch contact plate having a clip portion for receiving a tab of the external terminal plate inserted therein.

37. A modular block subassembly for a rocker-type switch according to claim 27, wherein said top and bottom block members are joined together by one of the following group of joining means: (a) said bottom block member being provided with spaced stacking pins on an upward facing surface thereof that are inserted into aligned holes in said top block member and ultrasonically welded thereto; (b) gluing the members together; (c) press-fitting the members together; and (d) welding the members together.

38. A modular block subassembly for a rocker-type switch according to claim 27, wherein the described parts are configured with a modular "drop in" design to allow assembly to be performed through automation.

39. A method of modularly assembling a block subassembly for a rocker-type switch employing at least one movable contact arm pivotable between opposing switch contact positions, comprising:

(a) providing an insulative top block member having upright walls defining at least one hollow space for receiving a lower end of the at least one movable contact arm therein;

(b) providing an insulative bottom block member to be joined to said top block member;

(c) providing at least one switch contact plate having one or more switch contacts mounted on upright tab(s) which are inserted through respective aligned slot(s) in said bottom block member and/or said top block member to a respective switch contact position(s);

(d) providing said at least one switch contact plate with means for establishing an electrical connection with a terminal plate positioned externally of said modular block subassembly; and (e) assembling said top and bottom block members together with said at least one switch contact plate, then establishing an electrical connection with a terminal plate positioned externally of said modular block subassembly.

40. A method for modularly assembling a block subassembly for a rocker-type switch according to claim 39, wherein said means for establishing an electrical connection with an external terminal plate includes said at least one switch contact plate having a clip portion for receiving a tab of the external terminal plate inserted therein.

* * * * *